US006957950B2

(12) United States Patent
Kamiya et al.

(10) Patent No.: US 6,957,950 B2
(45) Date of Patent: Oct. 25, 2005

(54) COMPRESSOR WITH COMPACT SCREW CONNECTED HOUSING AND ADJUSTABLE MOUNTING MEANS

(75) Inventors: Hirokazu Kamiya, Takahama (JP); Shigeru Kamiya, Nukata-gun (JP); Masafumi Inoue, Tajimi (JP); Takashi Inoue, Okazaki (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/356,624

(22) Filed: Feb. 3, 2003

(65) Prior Publication Data

US 2003/0156951 A1 Aug. 21, 2003

(30) Foreign Application Priority Data

Feb. 15, 2002 (JP) ..... 2002-038055

(51) Int. Cl.[7] ..... F04B 1/26; F04B 17/00

(52) U.S. Cl. ..... 417/222.1; 417/269; 417/360; 92/12.2; 92/91

(58) Field of Search ..... 417/269, 360, 417/366, 368, 372, 419, 902, 218, 222.1, 222.2; 248/637, 674, 672; 74/606 R; 92/12.2, 71, 129, 158, 169.1, 13

(56) References Cited

U.S. PATENT DOCUMENTS 2,381,585 A * 8/1945 Gambrell ..... 417/499
RE27,844 E * 12/1973 Olson, Jr. ..... 417/269
4,526,516 A * 7/1985 Swain et al. ..... 417/222.2
5,173,032 A * 12/1992 Taguchi et al. ..... 417/222.2
6,079,959 A * 6/2000 Kingsford et al. ..... 417/393
6,089,141 A * 7/2000 Okesaku ..... 92/129
6,168,389 B1 * 1/2001 Fukushima ..... 417/269
6,264,437 B1 * 7/2001 Porel ..... 417/390
6,460,823 B1 * 10/2002 Herder et al. ..... 248/637
6,786,704 B2 * 9/2004 Kamiya et al. ..... 417/222.2

FOREIGN PATENT DOCUMENTS

| | | | | |
|---|---|---|---|---|
| EP | 444447 A1 * | 9/1991 | ..... | F04B/27/08 |
| EP | 1114931 A2 * | 7/2001 | ..... | F04B/27/10 |
| GB | 2038950 A * | 7/1980 | ..... | F04B/39/02 |
| JP | 61149586 A * | 7/1986 | ..... | F04B/25/04 |
| JP | U-S63-10271 | 1/1988 | | |
| JP | A-H02-75778 | 3/1990 | | |
| JP | A-H10-103230 | 4/1998 | | |
| JP | A-2001-27177 | 1/2001 | | |

* cited by examiner

*Primary Examiner*—Charles G. Freay
(74) *Attorney, Agent, or Firm*—Posz Law Group, PLC

(57) ABSTRACT

According to the invention, a compressor having a threaded screw connection portion formed directly on a fitting portion of the housing is provided. Since no through bolt or the like for connecting two-parts of the housing is used, the diameter of the housing can be reduced. However, in a case that a suction port and discharge port do not align with an external mounting structure, a mounting means able to slide on the housing and adjust the positions of mounting brackets at least in the direction of rotation is added.

16 Claims, 7 Drawing Sheets

COMPRESSOR WITH COMPACT SCREW CONNECTED HOUSING AND ADJUSTABLE MOUNTING MEANS

BACKGROUND OF THE INVENTION

1. Field of the Invention

The present invention relates to a compressor, for a fluid, such as a refrigerant compressor used in an air-conditioning system.

2. Description of the Related Art

One example of a conventional compressor is described in Japanese Unexamined Patent Publication (Kokai) No. 2001-27177. The structure of this compressor is illustrated in FIG. 8. This compressor falls under the category of piston-type variable capacity compressor. The housing is comprised of a front housing 1, a cylinder block 2, and a rear housing 3. A plurality of pistons 7 are inserted into the plurality of cylinder bores 21 formed in the cylinder block 2, and are forced to engage in reciprocating motion by a common drive plate 5. The drive plate 5 is driven to rotate by a shaft 4. This drive plate 5 enables the tilt angle to be smoothly changed and thus enables the discharge capacity of the compressor to be continuously changed. Further, a plurality of mounting brackets 28 to secure this compressor with some objective equipment are formed integrally on the front housing 1 and cylinder block 2, respectively.

In order to integrate the front housing 1, cylinder block 2 and rear housing 3, this compressor has a plurality of through bolts 40 as used frequently in conventional compressors. In a conventional compressor, these through bolts 40 are provided with the outside of the housing in an exposed state. However, due to the plurality of through bolts 40, and as the diameter of the compressor becomes larger by at least the diameter of a through bolt 40, there arises a problem that the size of the compressor as a whole becomes larger.

SUMMARY OF THE INVENTION

An object of the present invention is to eliminate this problem in the related art by adding a novel configuration to the compressor, and to provide a much smaller compressor than a conventional compressor having the same degree of discharge capacity.

According to the invention, as a means for solving the problem described above, there is provided a compressor comprising a housing rotatably supporting a shaft and constituted from a plurality of parts aligning in the axial direction of the shaft and integrated with each other, a faucet joint portion provided between an end portion of one part of the housing and an end portion of another one part adjacent to the one part, and a screw connection portion formed on an inner and outer contact surfaces of the fitting portion, and wherein the one and other parts of the housing are connected and integrated with each other only by the screw connection portion formed with the fitting portion.

In this compressor, an end portion of one part among a plurality of parts constituting the housing and an end portion of another one part adjacent to the one part are integrated by a screw connection portion formed in a fitting portion provided between these two end portions. Therefore, it is possible to eliminate through bolts, etc. As the screw connection portion in the fitting portion can be formed without substantial increase of the diameter of the housing, the compressor can be made smaller as a whole.

In the compressor according to the present invention, at least one of mounting bracket, which can be adjusted in position with respect to the housing, can be provided with a mounting means for securing the housing with some objective equipment. This mounting bracket can be made slidable and adjustable with respect to the housing in at least a rotational direction. Therefore, when the position of a suction port or discharge port and the relative angle between a plurality of mounting brackets do not align with the corresponding position or angle on the objective equipment by using the screw connection portion formed in the fitting portion, the positional relationship between the compressor and objective equipment is readily adjustable by adjusting the position or angle of the mounting bracket with respect to the housing.

The present invention can be suitably applied to a piston-type variable capacity compressor, whereby the dimension of this compressor also can be made smaller as a whole.

BRIEF DESCRIPTION OF THE DRAWINGS

These and other objects and features of the present invention will become clearer from the following description of the preferred embodiments given with reference to the attached drawings, wherein.

DESCRIPTION OF THE PREFERRED EMBODIMENTS

Preferred embodiments of the present invention will be described in detail below while referring to the attached figures.

Figure 1:
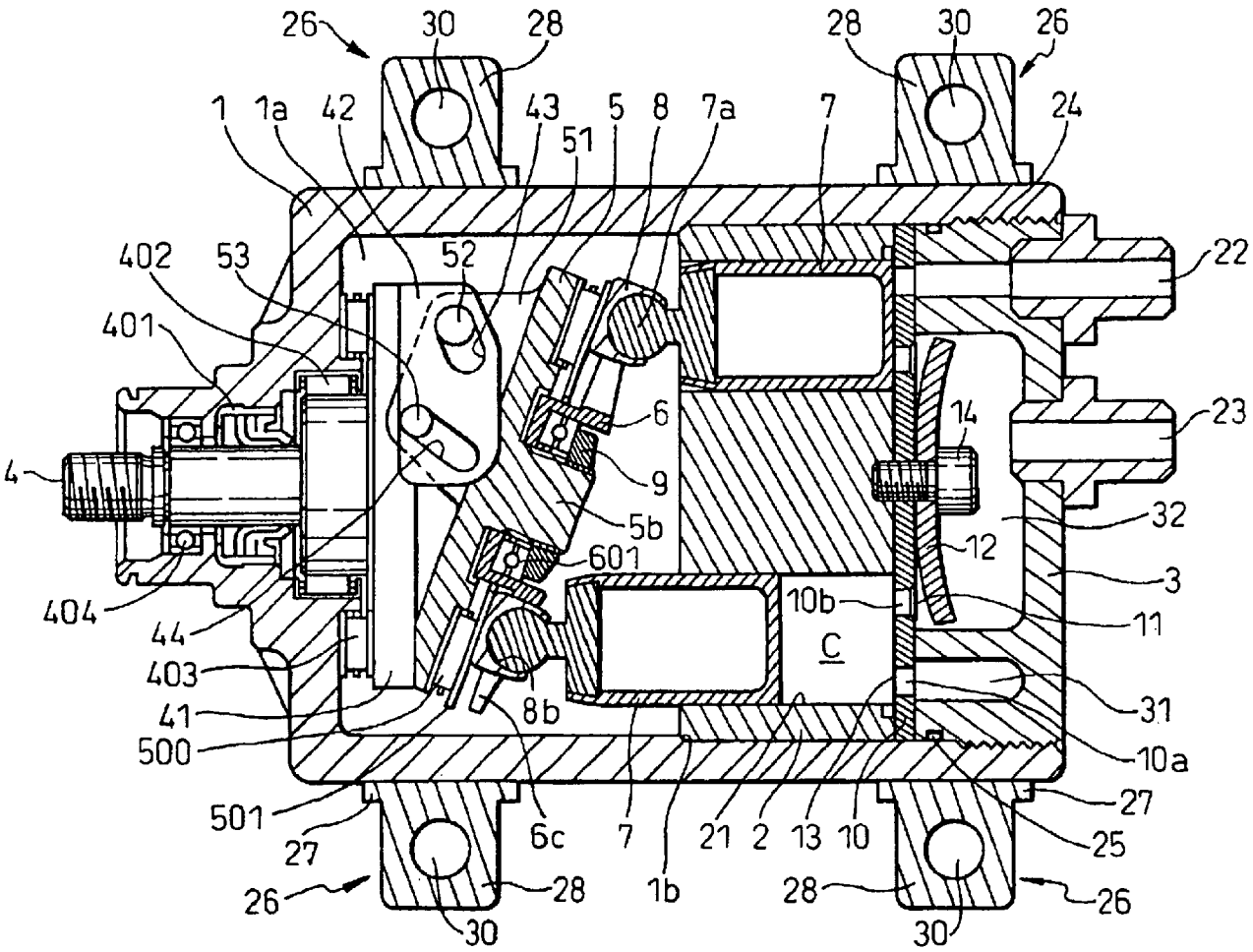
FIG. 1 is a longitudinal sectional view showing a first embodiment of a compressor of the present invention.

FIG. 1 to FIG. 4 show a first embodiment of a compressor of the present invention. The compressor of the first embodiment belongs to a piston-type variable capacity compressor, in which a piston is moved in a reciprocating motion by a drive plate (swash plate) rotating with a shaft, whereby a fluid in a working chamber is compressed. Due to a change in the tilt angle of the drive plate, the stroke of the piston and the discharge capacity of the compressor can be steplessly changed. In FIG. 1, which shows the longitudinal sectional structure of the compressor as a whole in an operating state giving the maximum discharge capacity, reference numeral 1 is a front housing shaped as a closed bottom cylinder and constituting part of a shell of the compressor, while 2 is a cylinder block which has a external cylindrical surface whereby inserted into the front housing 1 and is secured with the front housing 1 in a manner as explained later. At the inside of the cylinder block 2, a plurality of (for example, six) cylinder bores 21 are formed extending in the lateral direction in FIG. 1 (axial direction) generally equidistantly around a center axis.

Corresponding to a feature of the invention, a female screw thread is formed on the inner surface at the rear end of the front housing 1. A rear housing 3 connected to such part of the front housing 1 has a generally flat and cylindrical shape and a male screw thread is formed on part of the outer peripheral portion thereof. Due to the connection of these male and female screw threads, a screw connection portion 24 is formed, and the rear housing 3 is secured at the rear end of the front housing 1 to close and seal. As a general consideration, at the end portions of a plurality of constituting parts of the housing such as front housing 1 and rear housing 3, in which they are connected each other, a fitting portion in which one and the other of them overlap in an inner and outer positional relationship is formed. Further, due to the screw threads formed on the inner and outer contact surfaces of the fitting portion, and directly engaged with each other, the screw connection portion 24 is constituted.

As a result, in the case of the first embodiment, the cylinder block 2 is pressed toward a stepped portion 1*b* formed inside of the front housing 1 and secured together. Also valve port plate 10, discharge valve 11 and suction valve 13 made of a thin sheet of spring steel are sandwiched between the cylinder block 2 and rear housing 3, and fixed there. Note that, to enhance the sealing performance between the front housing 1 and the rear housing 3, a seal ring (O-ring) 25 made of rubber is provided.

Figure 2:
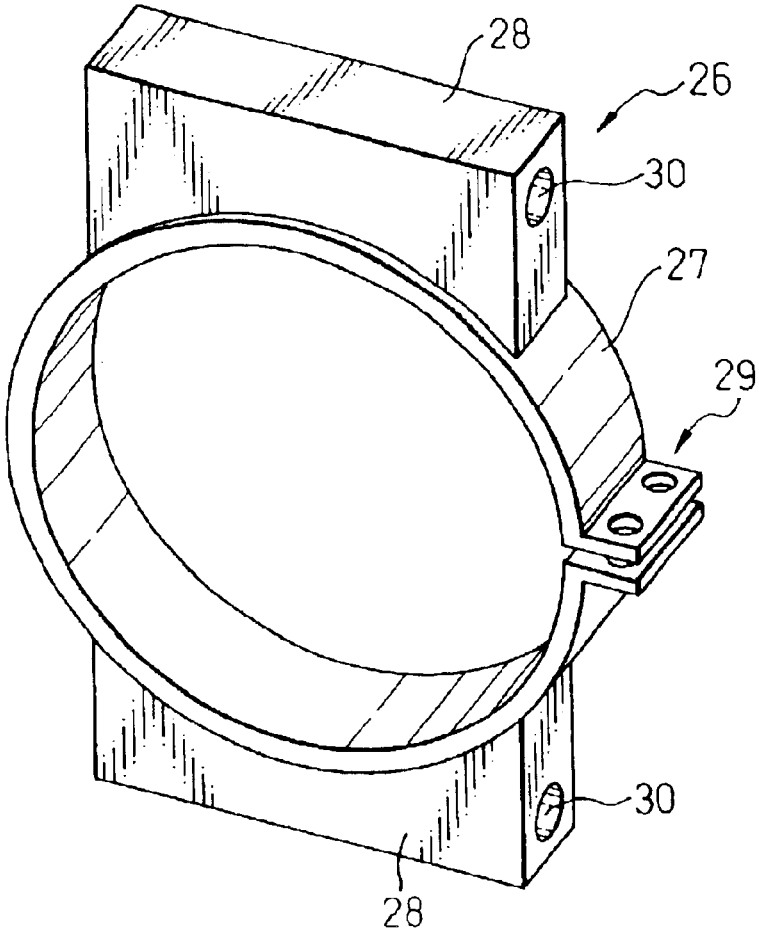
FIG. 2 is a perspective view of a charactering part of the first embodiment.

Corresponding to another feature of the invention, on the outer peripheral surface of the portion adjacent to the front end of the front housing 1 and the portion adjacent to the rear end of the same, at least one of mounting means 26 to attach the compressor to some objective equipment, for example, air-conditioning system, is provided. A shape and a construction of the mounting means 26 in the first embodiment are illustrated in FIG. 2. That is, the mounting means 26 in this example comprises a ring-shaped fixing band 27 made of elastic metal, etc., such as a steel sheet wrapping the outer periphery of the front housing 1, a block-type mounting bracket 28 made from metal or plastic, etc., integrated to suitable position of the fixing band 27, and a connecting portion 29 connecting the both ends of the fixing band 27 each other at a joint of the fixing band 27, etc.

The connecting portion 29 in this case comprises a pair of L-shaped portions formed at the both ends of the fixing band 27 at the joint, a bolt connecting those L-shaped portions each other, not shown, etc. Note that, in each mounting bracket 28, a hole 30 to insert the bolt for mounting, not shown, is formed. The mounting means 26 of the first embodiment having such a shape or construction is provided with front side and rear side of the front housing 1, respectively. Each mounting means 26 has two mounting brackets 28 at the symmetrical positions, however, it is of course that the present invention is not limited such a construction.

Next, an internal construction of the piston-type variable capacity compressor of the first embodiment will be explained. First, a suction chamber 31 is formed at the outer periphery at the inside of the rear housing 3, while a discharge chamber 32 is formed at the central portion of the same. A suction port 22 introducing a fluid to be compressed from an external portion is attached to the suction chamber 31, while a discharge port 23 introducing a compressed fluid to the external portion is attached to the discharge chamber 32.

Reference numeral 4 is a shaft for receiving rotational power from an external power source. A disk part 41 is formed integrally perpendicular to the same. A single radial direction arm 42 is provided to project, generally in the axial direction, from part of the outer periphery of the disk part 41. At the arm 42 are formed two guide grooves serving as cams, that is, a top guide groove 43 and a bottom guide groove 44, in predetermined shapes at predetermined positions at the top and bottom.

The shaft 4 is axially supported by the front housing 1 through radial bearings 402 and 404 and is axially supported by the front housing 1 in the axial direction as well through a thrust bearing 403 supporting the back surface of the disk part 41. Accordingly, the shaft 4 is supported only by the front housing 1 and it is not supported by the cylinder block 2. Note that shaft sealing devices 401 are provided at these bearing parts to prevent fluid from leaking from around the shaft 4 to the outside.

Reference numeral 5 is a drive plate (swash plate) generally in a disk shape. The drive plate 5 is provided with two radial direction arms 51 projecting from its back surface toward the disk part 41 and supports two pins 52 and 53 between the two arms 51. These pins 52 and 53 are inserted into the top guide groove 43 and bottom guide groove 44 formed in the above-mentioned arm 42 at the shaft 4 side to be slidably engaged with the same. Due to this, the drive plate 5 can rotate together with the shaft 4 and can tilt with respect to the shaft 4.

The shaft part 5*b* of the drive plate 5 has fitted on it a shoe holding plate (retainer) 6 having an opening at its center. This is rotatably connected with the drive plate 5 by a drive thrust bearing 500, a holding plate thrust bearing 601 and a holding nut 9. The shoe holding plate 6 grips the later-explained shoes 8 and drive thrust bearing 500 to the drive plate 5 and is used to guide movement of the shoes 8 in the radial direction. Note that the shaft part 5*b* of the drive plate 5 is provided with a male thread for screwing into the holding nut 9.

Figure 3:
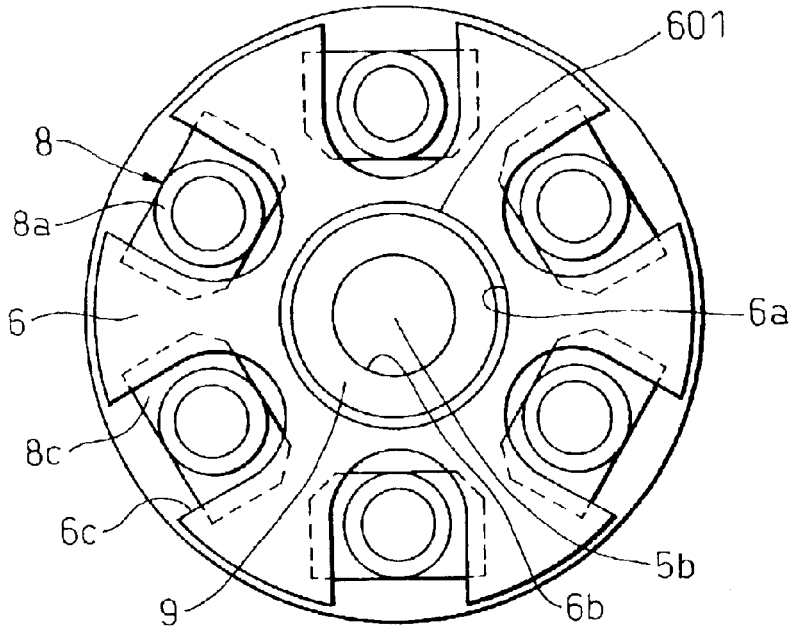
FIG. 3 is a side view illustrating the related parts of a shoe holding plate and shoes.

The specific shape of the shoe holding plate 6 in the illustrated embodiment will be clear if FIG. 3 and FIG. 1 are considered. The shoe holding plate 6 is provided with a circular depression 6*a* at the center and can house the holding plate thrust bearing 601 in that depression 6*a*. At the center of the depression 6*a* is formed a center opening 6b for engaging with the shaft part 5*b* of the drive plate 5. At the periphery of the shoe holding plate 6 are formed the exact same number of shoe guide grooves 6*c* formed by radially extending U-shaped cutaway parts as the number of pistons 7 (for example, six).

Figure 4:
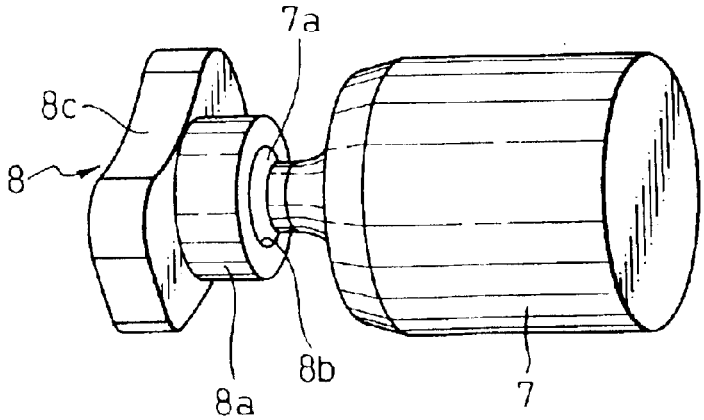
FIG. 4 is a perspective view illustrating a shoe and piston.

Each shoe guide groove 6*c* has slidably engaged with it a shoe body 8*a*, of a shape close to a closed bottom cylinder, of a shoe 8, having abrasion resistance, of the shape shown in FIG. 4. The shoe holding plate 6 is connected rotatably relative to the drive plate 5 but, as the shoe body 8*a* fitted on the spherical end 7*a* of the piston 7 is engaged with the U-shaped shoe guide groove 6*c* of the shoe holding plate 6, rotation of the shoe holding plate 6 is prevented and only a rocking motion is performed along with a tilted rotary motion of the drive plate 5.

As shown in FIG. 1 and FIG. 4, each shoe 8 is formed with a spherical depression 8*b* into which a spherical end 7*a* formed at one end of a piston 7 is press-fitted, whereby the end is engaged with the shoe 8 in a rotatable and slidable manner. Further, each shoe 8 is formed with a shoe flange 8*c* projecting out from the shoe body 8*a* to the sides. Each shoe flange 8*c* is pressed by the two side portions of the corresponding shoe guide groove 6*c* formed in the shoe holding plate 6. Thus, the piston 7 to which the shoe 8 is attached is inserted slidably in an above-mentioned cylinder bore 21.

The holding nut 9 screwed over the male thread formed at the shaft part 5*b* of the drive plate 5 presses the shoe holding plate 6 toward the drive thrust bearing 500 and drive plate 5 through the holding plate thrust bearing 601. Due to this, the shoe holding plate 6 simultaneously presses the plurality of shoes 8 on to the drive thrust bearing 500. In this way, the thrust bearing 500, the plurality of shoes 8, the shoe holding plate 6, and the holding plate thrust bearing 601 are assembled on the drive plate 5. Note that reference numerals 501 shown in FIG. 1 is ring-shaped plate forming part of the drive thrust bearing 500.

Reference numeral 10 is a valve port plate having at least one each of a suction port 10*a* and discharge port 10*b* passing through the same at positions corresponding to each cylinder bore 21. Each suction port 10*a* of the valve port plate 10 is closed off from the suction chamber 31 of the rear housing 3 from the cylinder bore 21 side by part of the suction valve 13 made of a single thin sheet of spring steel. Each discharge port 10*b* is closed off from the discharge chamber 32 side in the rear housing 3 again by part of the discharge valve 11 made of a single thin sheet of spring steel. The discharge valve 11 is simultaneously fastened when a valve holder 12 protecting it is screwed to a valve port plate 10 by a bolt 14. Further, the valve port plate 10 and suction valve 13 are fastened by being gripped between the front housing 1 and cylinder block 2 and the rear housing 3 when these are fastened together as a whole.

As explained above, in the compressor of the first embodiment, as the front housing 1 and the rear housing 3 are detachably integrated by the screw connection portion 24, in comparison with a conventional compressor provided a plurality of through bolts at the outside or the inside of a housing, it is possible to reduce the diameter of the housing 1, at least by the part of the plurality of through bolts. So there is an advantage that the compressor can be made smaller as a whole.

On the other hand, if the mounting brackets 28 to attach the compressor to some objective equipment such as air-conditioning system are directly provided with the external surface of the front housing 1, a relative and positional relationship between the front housing 1 and the objective equipment is decided definitely. However, when the rear housing 3 is attached to the front housing 1 by the screw connection portion 24, as the physical (positional) relationship in the rotational direction between both housings 1 and 3 is indefinite, a problem that the positions of the suction port 22 and discharge port 23 do not coincide with the positions of the corresponding parts in the objective equipment occurs.

In the first embodiment, to solve this problem, the relative and positional relationship in the rotational direction and the axial direction between the front housing 1 and mounting means 26 is adjustable. That is, after the mounting bracket 28 of the mounting means 26 was attached to the corresponding portion of the objective equipment, bolts of the connecting portion 29, etc., are loosened, and the front housing 1 is slid in the fixing band 27 in the rotational direction or the axial direction and the suction port 22 and the discharge port 23 are coincided with the corresponding portions of the objective equipment and coupled respectively. Then, due to the connecting portion 29 being in such a state, the positional relationship between the mounting means 26 and the front housing 1 is fixed.

Next, the operation of the drive plate type variable capacity compressor of the first embodiment will be explained.

When the shaft 4 is driven to rotate by an external power source such as an internal combustion engine or motor mounted in a vehicle, the drive plate 5 connected to the disk part 41 of the shaft 4 through the arm 42, top and bottom guide grooves 43 and 44, two pins 52 and 53, and two arms 51 rotate together with the shaft 4. The shoe holding plate 6, however, is supported with respect to the drive plate 5 through the holding plate thrust bearing 601, and the plurality of shoes 8 engaged with the shoe guide grooves 6*c* engage with the spherical ends 7*a* of the pistons 7, so the plate does not rotate. Therefore, only when the drive plate 5 is tilted with respect to the imaginary plane perpendicular to the shaft 4, the shoe holding plate 6 engages in rocking motion of a magnitude corresponding to its tilt angle while gripping the drive thrust bearing 500 and plurality of shoes 8 with the drive plate 5. Due to this, the plurality of shoes 8 gripped between the shoe holding plate 6 and the drive plate 6 through the drive thrust bearing 500 and the plurality of pistons 7 connected with the same engage in a reciprocating motion in the cylinder bores 21.

In the case of the first embodiment, when the two pins 52 and 53 move by sliding in the top guide groove 43 and bottom guide groove 44 at the shaft 4 side, the drive plate 5 and the shoe holding plate 6 change in tilt angle with respect to a supposed plane perpendicular to the shaft 4, so the strokes of all of the pistons 7 change simultaneously by exactly the same amounts. Due to this, the discharge capacity of the compressor changes steplessly.

The working chamber C formed at the top face of each piston in the suction stroke among the plurality of pistons 7 expands and reaches a low pressure, so the fluid to be compressed in the suction chamber 31, for example, the refrigerant of an air-conditioning system, pushes open the suction valve 13 provided at the suction port 10*a* of the valve port plate 10 and flows in. As opposed to this, the working chamber C formed at the top face of each piston 7 in the compression stroke contracts, so the fluid inside it is compressed and becomes a high pressure and pushes open the discharge valve 11 provided at the discharge port 10*b* of the valve port plate 10 to be discharged to the discharge chamber 32. The discharge capacity in this case is generally proportional to the length of the stroke of the piston 7 determined by the tilt angle of the drive plate 5 and the shoe holding plate 6.

By changing the tilt angle of the drive plate 5 and the shoe holding plate 6 in this way, the discharge capacity of the compressor changes, so the discharge capacity may be controlled in the compressor of the first embodiment by changing the pressure in the front housing chamber 1*a* forming the back pressure of all of the pistons 7 using a not shown pressure control valve etc. Normally, a pressure intermediate between the high pressure of the discharge chamber 32 and the low pressure of the suction chamber 31 is introduced from the pressure control valve.

If the pressure in the front housing chamber 1*a*, that is, the back pressure of all of the pistons 7 is raised, the state of balance with the pressure in the working chamber C formed at the top face of each piston 7 is lost, and the average position of the pistons 7 in the reciprocating motion moves toward a position close to the valve port plate 10 until a new state of balance is obtained. Due to this, the strokes of all of the pistons 7 become smaller, so the discharge capacity of the compressor is smoothly reduced.

As opposed to this, if a not shown pressure control valve is operated to reduce the pressure in the front housing chamber la, the back pressure acting on the pistons 7 becomes smaller, so the strokes of all of the pistons 7 become larger all together and the discharge capacity of the compressor becomes smoothly larger. FIG. 1 shows the state where the pressure in the front housing chamber 1*a* becomes a minimum so the tilt angle of the drive plate 5 and shoe holding plate 6 becomes larger to the maximum extent and where the strokes of the pistons 7 and the discharge capacity of the compressor become a maximum.

Figure 5:
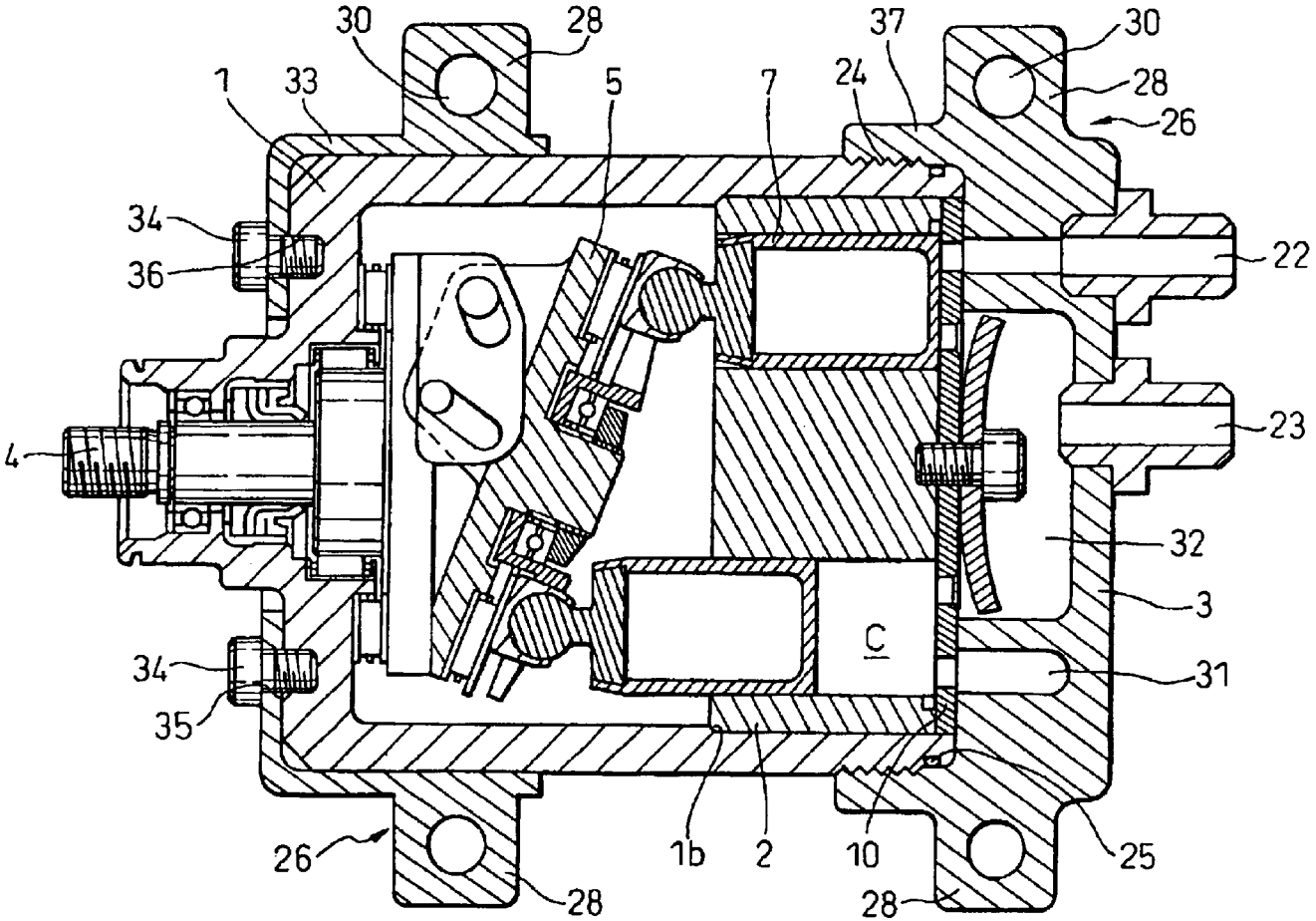
FIG. 5 is a longitudinal sectional view showing a compressor of a second embodiment.
Figure 6:
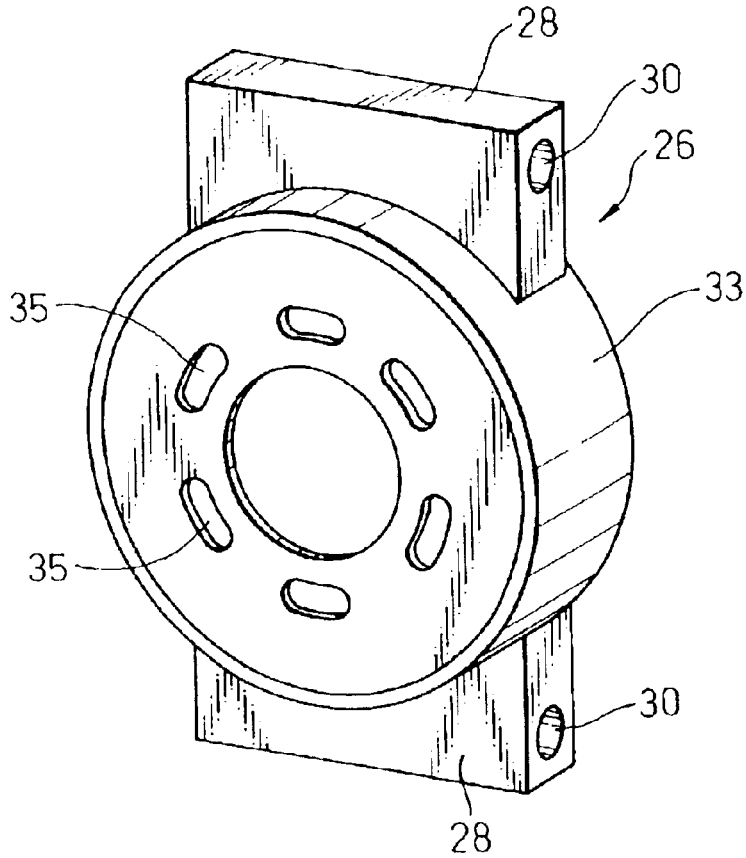
FIG. 6 is a perspective view of a charactering part of the second embodiment.

Next, a second embodiment of a compressor of the present invention shown in FIG. 5 and FIG. 6 will be explained. Since the core portion of the compressor in the second embodiment is the same as the piston-type variable capacity compressor in the first embodiment, the basic construction or the operation of the compressor in the second embodiment is also the same as the first embodiment. Further, since the later mentioned third embodiment is also the same, construction parts substantially similar to the first embodiment in a embodiment after the second embodiment, are given the same reference numerals, thereby overlapping detailed explanations are omitted.

The difference between the compressor of the second embodiment and the compressor of the first embodiment is in the mounting means 26. In the second embodiment, the mounting means 26 provided on the front end portion of the front housing 1 differs from the mounting means 26 provided on the rear end portion of the same. The mounting means 26 provided on the front end portion comprises a thin and deep dish-shaped cover 33 attached so as to cover the front end surface of the front housing 1 of the compressor, at least one mounting bracket 28 integrated with a suitable position on the cover 33, and a plurality of bolts 34 securing the cover 33 to the front end surface of the front housing 1. A plurality of arcuate slits 35 to insert the bolts 34 are formed in the front surface of the cover 33, also a plurality of female screw thread holes 36 engaging with the bolts 34 inserted through the slits 35 are formed in the front end surface of the front housing 1. The mounting bracket 28 is the same as in the first embodiment and a hole 30 is formed.

In the second embodiment, a screw connection portion 24 is formed at a fitting portion between an outer peripheral surface at the rear end of a cylindrical front housing 1 and the inner peripheral surface of a short cylindrical portion 37 integrally formed to project from a rear housing 3 toward the front side, whereby the front housing 1 and the rear housing 3 are integrated with each other. Accordingly, the positional relationship between the front housing 1 and the rear housing 3 in the second embodiment is opposite to the case in the first embodiment. However, also in this case, as a screw connection portion 24 is used, in comparison with a conventional compressor using through bolts, the diameter of the housing is reduced, and the compressor of the second embodiment can be made smaller, as a whole.

The mounting means 26 of the compressor which one arranged at the rear end of the front housing 1, is formed by using the rear housing 3. That is, in the second embodiment, at least one mounting bracket 28 is formed integrally with the outer peripheral surface of the rear housing 3 having a suction port 22 and a discharge port 23. Therefore, with respect to the mounting means 26 provided with rear housing 3, there is no particular need to adjust the positional relationship between the compressor and the objective equipment.

In this case, an adjustment of the positional relationship between front housing 1 and the mounting means 26 arranged at the front end of the front housing 1 only is needed. That is because, in a state that the rear housing 3 is integrated with the front housing 1 by the screw connection portion 24 formed on the fitting portion, the positional relationship in the rotational direction between the front housing 1 and rear housing 3 is unspecified. Therefore, if a mounting bracket 28 is fixed to the front housing 1, a case that the mounting bracket 28 does not align with the same of the rear housing 3 may occured.

Therefore, in the second embodiment, the mounting means 26 provided with the front end of the front housing 1 is adjusted in the rotational direction to the front housing 1 itself. By firstly loosing bolts 34, then, by rotating the cover 33 to the front housing 1, in the range of the arcuate slits 35 formed in the cover 33, this adjustment can be easily carried out. The bolts 34 are secured again after the adjustment is finished. Therefore, when the screw connection portion 24 is secured, the mounting means 26 of the front end of the front housing 1 can be easily adjusted in the rotational direction even if the mounting means 26 on the cover 33 does not align with the same on the rear housing 3, and thereby the suction port 22 and discharge port 23 can be aligned with corresponding portions of the objective equipment.

Figure 7:
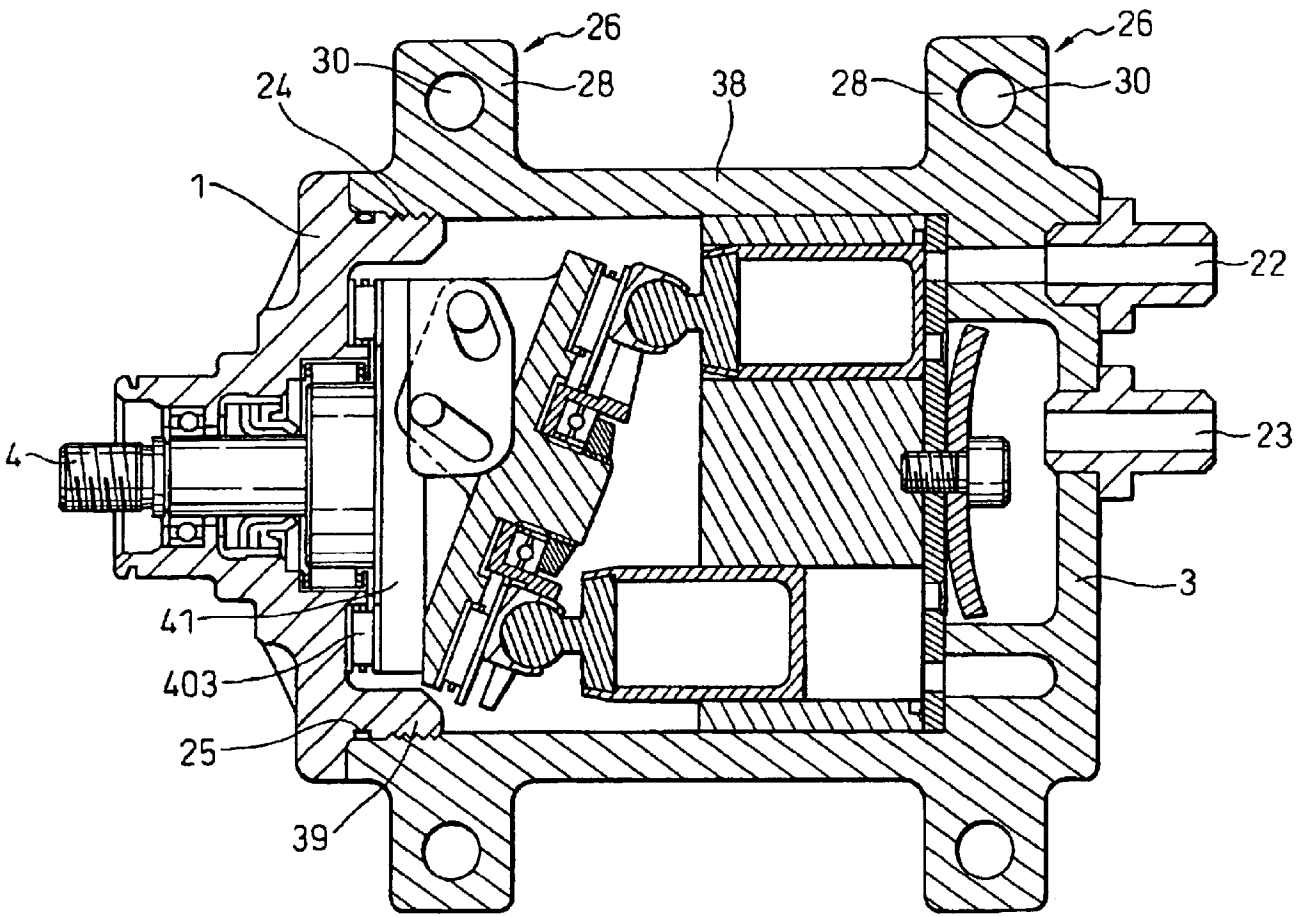
FIG. 7 is a longitudinal sectional view showing a compressor of a third embodiment.
Figure 8:
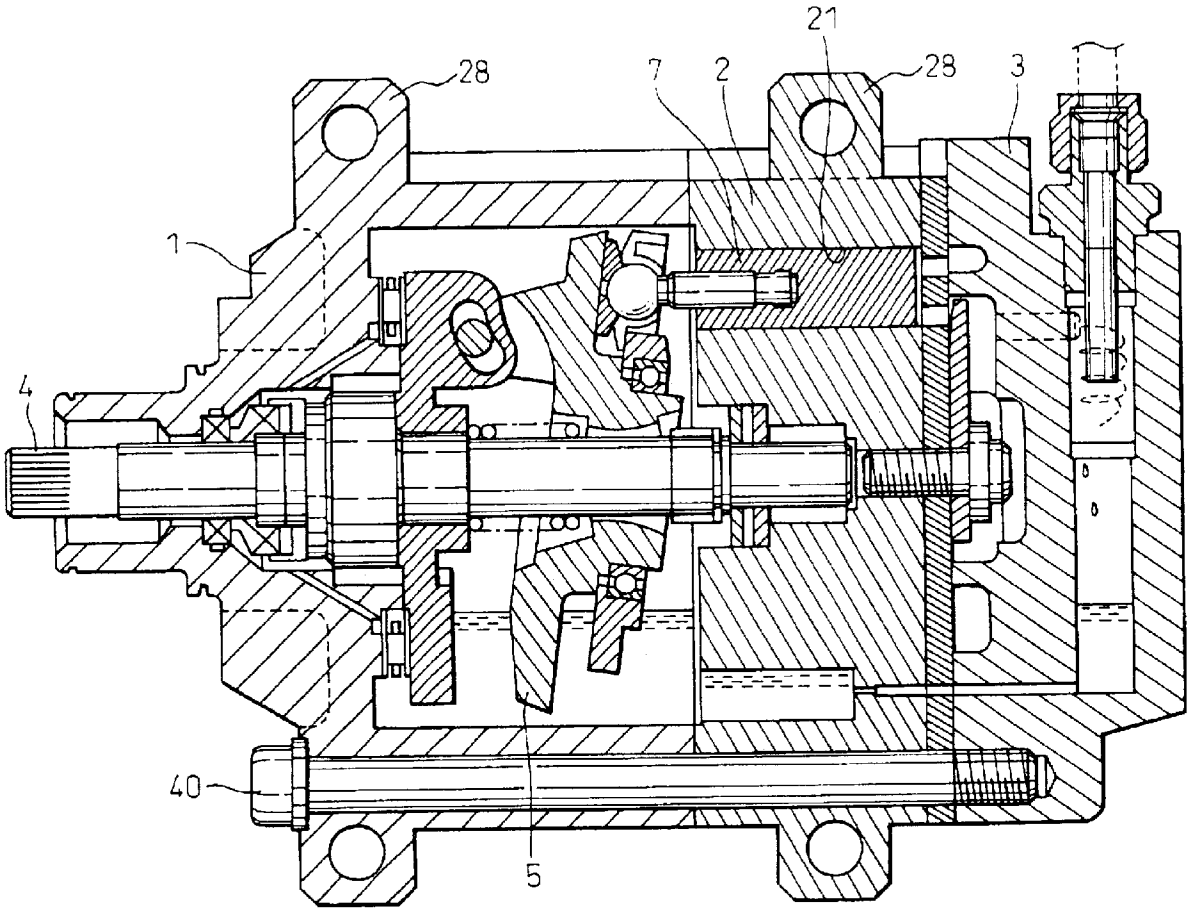
Fig. 8 PRIOR ART
FIG. 8 is a longitudinal sectional view illustrating a conventional compressor.

FIG. 7 shows a third embodiment of the present invention. Also in the third embodiment, the body portion of the compressor is a piston-type variable capacity compressor the same as in the first embodiment or in the second embodiment. As a feature of the third embodiment, the length of the front housing 1 in the axial direction is short. Accordingly, the rear housing 3 is provided with a comparatively long cylindrical trunk portion 38 integrally extending forward in the axial direction from the rear end, and a screw connection portion 24 is formed in a fitting portion between the front end of the cylindrical trunk portion 38 and a cylindrical portion 39 formed in the axial direction at the front housing 1. The mounting means 26 of the compressor to the objective equipment comprises several mounting brackets 28, etc., integrally provided with the front end and the rear end of the cylindrical trunk portion 38 of the rear housing 3 respectively.

In the case of the third embodiment, all of the mounting brackets 28 as the mounting means 26 of the front side and the rear side are provided at the front end and the rear end of the cylindrical trunk portion 38, which is integrated with the rear housing 3 attached a suction port 22 and a discharge port 23 thereto. The screw connection portion 24 having a fear caused variation of relatively positional relationship in rotational direction is provided between the front end of the cylindrical trunk portion 38 and the front housing 1 having no mounting bracket. Therefore, there is no need to provide any adjusting means for positional relationship between the mounting means 26 and the suction port 22 and discharge port 23. Further, even if the positional relationship in a rotational direction between the cylindrical trunk portion 38 and front housing 1 is varied due to screw up the screw connection portion 24, as a thrust bearing 403 is provided with this compressor, no problem will be caused on the operation of the compressor.

Also in the case of the third embodiment, as the front housing 1 is integrated with the rear housing 3 by the screw connection portion 24 formed in the fitting portion, the diameter of the compressor is reduced because there is no need for through bolts, and the compressor can be made smaller as a whole. In spite of the aforementioned fact, no problem is caused by the screw connection portion 24, as all of the mounting means 26 are provided with the side of the rear housing 3 integrated with the suction port 22 and discharge port 23.

Note that, all of the illustrated embodiments are related to the piston-type variable capacity compressor. However, it is obvious that the key parts of the present invention can be adapted to not only the piston-type variable capacity compressor but also a piston-type constant capacity compressor or another type of compressor. It is, of course, possible that, in this case, that the advantage of the present invention, that the compressor can be made smaller as a whole due to the elimination of through bolts, is obtained.

What is claimed is:

1. A compressor comprising:

a housing rotatably supporting a shaft and constituted from first and second parts aligned in an axial direction of said shaft and integrated with each other;

a fitting portion comprised of inner and outer housing portions, wherein the inner and outer housing portions are respectively formed at an end portion of said first part of said housing and an end portion of said second part;

a threaded screw connection portion comprised of inner and outer screw portions directly and respectively formed on inner and outer contact surfaces of said fitting portion, wherein the first and second parts of said housing are connected and integrated with each other only by said threaded screw connection portion formed with said fitting portion; and a mounting means for securing said housing to some objective equipment, wherein:

the mounting means includes a first mounting bracket able to adjust an attached position with respect to said housing;

a second mounting bracket is integrated with and immovably fixed to the second part of the housing; and said first mounting bracket is able to slide and adjust with respect to said housing at least in a direction of shaft rotation.

2. A compressor as set forth in claim 1, wherein the mounting means includes a fixing band, which is attached to said housing to be able to slide and adjust with respect to said housing to be able to slide and adjust with respect to said housing at least in the axial direction, and said first mounting bracket is fixed to said fixing band.

3. A compressor as set forth in claim 1, wherein a suction port and a discharge port are formed in the second housing member.

4. A compressor as set forth in claim 1, wherein one of said first and second housing parts overlaps the other of said first and second housing parts at said fitting portion, and an internal stepped portion is formed on an inside surface of the first housing part, wherein a cylinder block is pressed and secured between said stepped portion and a valve port plate, which is sandwiched between said cylinder block and the second housing part.

5. A compressor as set forth in claim 1, wherein the first housing part is overlapped by the second housing part at said fitting portion, wherein the second housing part has a short, integral, cylindrical portion that extends axially toward the first housing part, and wherein radial expansion of the first housing part due to internal pressure is restricted by said cylindrical portion.

6. A compressor according to claim 5, wherein the end portion of the first housing part is inside the fitting portion, and the end portion of the second housing part is outside the fitting portion.

7. A compressor as set forth in claim 1, wherein the mounting means includes:

a dish-shaped cover attached to an end surface of the housing, wherein the first mounting bracket is fixed to the cover;

a plurality of bolts for securing the cover to the end surface of the housing;

a plurality of arcuate slits formed in the cover to receive the bolts; and a plurality of threaded holes engaging with the bolts, wherein the threaded holes are formed in the end surface of the housing.

8. A compressor comprising:

a housing rotatably supporting a shaft and constituted from first and second parts aligned in an axial direction of said shaft and integrated with each other;

a fitting portion comprised of inner and outer housing portions, wherein the inner and outer housing portions are respectively formed at an end portion of said first part of said housing and an end portion of said second part;

a threaded screw connection portion comprised of inner and outer screw portions directly and respectively formed on inner and outer contact surfaces of said fitting portion, wherein the first and second parts of said housing are connected and integrated with each other only by said threaded screw connection portion formed with said fitting portion;

a drive plate rotating by being connected with and supported by said shaft and able to tilt with respect to said shaft at a tilt angle;

a shoe holding plate supported by said drive plate through a drive thrust bearing forming a roller bearing, wherein the shoe holding plate tilts with respect to said shaft at the tilt angle of the drive plate and is prevented from rotating;

a plurality of shoes engaging with a plurality of shoe guide grooves formed in radial direction at a peripheral part of said shoe holding plate and able to slide in the radial direction;

a plurality of pistons directly connected with said shoes and engaging in reciprocating motion, inserted in cylinder bores to suck in and compress a fluid, and preventing rotation of said shoe holding plate; and means for changing the tilt angle of said drive plate and said shoe-holding plate to change a discharge capacity.

9. A compressor comprising:

a housing rotatably supporting a shaft and constituted from first and second parts aligned in an axial direction of said shaft and integrated with each other;

a fitting portion comprised of inner and outer housing portions, wherein the inner and outer housing portions are respectively formed at an end portion of said first part of said housing and an end portion of said second part;

a threaded screw connection portion comprised of inner and outer screw portions directly and respectively formed on inner and outer contact surfaces of said fitting portion, wherein the first and second parts of said housing are connected and integrated with each other only by said threaded screw connection portion formed with said fitting portion;

a drive plate rotating by being connected with and supported by said shaft and able to tilt with respect to said shaft;

a shoe holding plate supported by said drive plate through a drive thrust bearing forming a roller bearing and thereby taking the same tilt angle;

a plurality of pistons inserted in cylinder bores to suck in and compress a fluid and preventing rotation of said shoe-holding plate;

a mechanism for converting tilted rotary motion of said drive plate to reciprocating motion of said pistons; and a slide link mechanism comprised of a plurality of pins and a plurality of guide grooves with which the pins engage is provided at a position away from the axial center of said shaft for connecting said shaft and said drive plate, as a means for changing the tilt angle of said drive plate to change a discharge capacity.

10. A compressor comprising:

a housing, wherein the housing supports a rotary shaft, and the housing is constituted by first and second parts, which are axially aligned with an axis of the rotary shaft, wherein the first and second housing parts are fastened to one another only by a threaded screw section of the housing, in which inner threads formed directly on an inner part of one of the first and second housing parts are engaged with outer threads formed directly on an outer part of the other of the first and second housing parts;

a first mounting bracket for attaching the compressor to a fixed structure;

a second mounting bracket for attaching the compressor to the fixed structure; wherein:

the first mounting bracket is attached to the first housing part, and the position of the first mounting bracket on the first housing part is adjustable;

the second mounting bracket is integrated with and immovably fixed to the second housing part; and the first mounting bracket is constructed and arranged to rotate with respect to said housing at least in the direction of shaft rotation to adjust the position of the first mounting bracket with respect to the first housing part.

11. A compressor as set forth in claim 10, wherein the first mounting bracket includes a band that surrounds the housing.

12. A compressor as set forth in claim 10, wherein a suction port and a discharge port are formed in the second part of the housing.

13. A compressor as set forth in claim 10, wherein one of the first and second housing parts overlaps the other of the first and second housing parts at the threaded screw section of the housing, and the compressor further comprises:

a valve port plate, which is sandwiched between the first and second housing parts;

an internal annular step formed on an inside surface of one of the first and second housing parts;

a cylinder block pressed and secured between the annular step and the valve port plate.

14. A compressor as set forth in claim 10, wherein the first housing part is overlapped by the second housing part at said threaded screw section, wherein the second housing part has a short, integral, cylindrical portion that extends axially toward the first housing part, and wherein radial expansion of the first housing part due to internal pressure is restricted by said cylindrical portion.

15. A compressor according to claim 14, wherein the end portion of the first housing part is inside the fitting portion, and the end portion of the second housing part is outside the fitting portion.

16. A compressor as set forth in claim 10 further comprising:

a dish-shaped cover attached to an end surface of the first housing part, wherein the first mounting bracket is fixed to the cover;

a plurality of bolts securing the cover to the end portion of the first housing part;

a plurality of arcuate slits formed in the cover to receive the bolts; and a plurality of threaded holes engaging with the bolts, wherein the threaded holes are formed in the end surface of the first housing part.

* * * * *